US007914307B1

(12) United States Patent
Yang

(10) Patent No.: US 7,914,307 B1
(45) Date of Patent: Mar. 29, 2011

(54) SOCKET WITH MOVABLE LIDS FOR SHIELDING PLUG HOLES

(75) Inventor: Wen-Ho Yang, Taipei County (TW)

(73) Assignee: Goldweal Far East Ltd., Dongguan, Guangdong Province (CN)

( * ) Notice: Subject to any disclaimer, the term of this patent is extended or adjusted under 35 U.S.C. 154(b) by 0 days.

(21) Appl. No.: 12/662,699

(22) Filed: Apr. 29, 2010

(51) Int. Cl.
*H01R 13/44* (2006.01)

(52) U.S. Cl. ..... 439/137; 439/145

(58) Field of Classification Search ..... 439/137, 439/135, 139, 145
See application file for complete search history.

(56) References Cited

U.S. PATENT DOCUMENTS

| | | | | |
|---|---|---|---|---|
| 6,422,880 | B1 * | 7/2002 | Chiu | 439/137 |
| 6,537,088 | B2 * | 3/2003 | Huang | 439/137 |
| 6,537,089 | B1 * | 3/2003 | Montague | 439/145 |
| 6,555,771 | B2 * | 4/2003 | Shao | 200/51 R |
| 6,776,630 | B1 * | 8/2004 | Huang | 439/137 |

* cited by examiner

*Primary Examiner* — Hien Vu
(74) *Attorney, Agent, or Firm* — Bacon & Thomas, PLLC

(57) ABSTRACT

A socket featuring movable lids for shielding plug holes is characterized by accommodating a set of movable lids: a first lid, a second lid and an elastic member in a cavity of its panel, where the first lid and the second lid are used to barricade the first notch and the second notch respectively by the bottoms of their tapered surfaces. A user, on occasion, is inserting a stick-like object into a single plug hole incidentally or intentionally, the first lid and the second lid will hold up each other to barricade the corresponding notch to avoid the stick-like object to touch the specific conducting clip, keeping the user from the hazard of an electrical shock.

2 Claims, 4 Drawing Sheets

SOCKET WITH MOVABLE LIDS FOR SHIELDING PLUG HOLES

BACKGROUND OF THE INVENTION

1. Field of the Invention

This invention relates generally to a socket and more specifically to one featuring movable lids for shielding plug holes, which is used for the occasions that a user is inserting a stick-like object into any of the plug holes of the socket incidentally or intentionally, where the movable lids are available to barricade the insertion of the stick-like object, to keep the user from the hazard of an electrical shock.

2. Description of the Prior Art

Electric power has been broadly using in the daily lives since its utilization, including all kinds of electric appliances, for instance: refrigerators, electric fans, washers, lightings, computers and the like, which are all activated by the electric power to enrich life. To make use of the electric power is subject to the insertion of the two (or three) pins of the plug of the power cord of an electric appliance in the plug holes of the socket (could be a wall type or an extension cord) for the electric connection purpose, and the electric appliance is then available for use and which signifies the importance of the sockets. In terms of structural combination, prior sockets comprise: a shell, having a hollow internally for the accommodation of two conducting clips, which are connected to the bare ends of the power cord for the electric conduction; a panel, having at least two plug holes that penetrate the panel and correspond to the conducting slips respectively, where the plug holes each is plugged in by the corresponding pin of at least two pins of an electric plug, which enables contact and clamping of the two pins by the conducting clips, for the conduction of the electric power from the power cord to those two pins.

The aforementioned structural combination and usage of the prior sockets are fairly familiar to the majority of the public and belong to frequent experiences of their daily lives. However, the prior sockets have a severe defect, that is, the path from each plug hole on the panel to the corresponding conducting clip is uncovered; therefore, those children with exceeding curiosity are quite easy to insert a stick-like object into any of the plug holes of the socket, to touch the corresponding conducting clip. Once the object is electrically conductive, an electric shock or a short circuit is brought about easily, which substantially endangers those children.

SUMMARY OF THE INVENTION

In light of the aforesaid drawbacks, this inventor conceived deeply the idea for the research of the invention, and eventually the longtime endeavors gave birth to this invention.

The objective of this invention is to provide a socket featuring movable lids for shielding plug holes, which is used for the occasions that a user is inserting a stick-like object into any of the plug holes of the socket incidentally or intentionally, where the movable lids are available to barricade the insertion of the stick-like object to touch a corresponding conducting clip, to keep the user from the hazard of an electrical shock.

To accomplish the aforementioned objective, a socket featuring movable lids for shielding plug holes of this invention comprises a shell, a panel, a conducting clip and a set of movable lids, wherein:

The shell has an empty top and is covered by a partition, to form a hollow internally, where the partition is provided with at least a first notch and a second notch that penetrate the partition, and an adjacent clamping trough is set up at the side facing to the first notch.

The panel is placed on top of the partition, and forms a firm joint with the shell, where the panel is provided with at least a first plug hole and a second plug hole that penetrate the panel, which correspond to the first notch and the second notch respectively, and the panel is set up with an inward cavity at its bottom and further with a clamping groove on top of the cavity and at somewhere corresponding to the clamping trough;

The number of conducting clips is equal to the quantity of plug holes, where the conducting clips are fixed in the hollow of the shell and each forms a clipping space, and both clipping spaces correspond to the first notch and the second notch of the partition respectively;

The set of movable lids is made up of a first lid, a second lid and an elastic member, where the first lid is in the shape of a chunk on which one lateral is formed into a tapered surface and its opposite lateral is provided with a rib, and each side of the rib is protruded to form an extension that further forms a bulge at its end portion, which is targeted to set up an indent in between the rib and the bulge, and a protrusion is shaped at the bottom of the first lid; the second lid is in the shape of a chunk too, where its lateral opposite to the first lid is set up with an indentation in which a pressing pole is shaped, and the lateral connecting to the first lid is set up with a tapered surface, where an extension is projected at each of its two sides and a bulge is further formed at the end portion, and a bump is shaped at the bottom of each extension, where a recess is formed at the outside of the bump while an indent at its inside, and a protrusion is shaped at the bottom of the second lid; during the assembly, the bumps of the second lid are lodged in the corresponding indents of the first lid, to enable the recess to touch slightly the rib; meanwhile, the bulges of the first lid are exactly fit in the indents of the second lid respectively, followed by the wearing of one end of the elastic member on the pressing pole for a firm fixing;

In assembling, the whole set of the movable lids are placed in the cavity of the panel that the front rim of the tapered surface of the first lid and the other end of the elastic member are propping against two opposite inner walls respectively for a steady fixing; the conducting clips are placed in the hollow of the shell for immobilization, followed by placing the partition on the shell, to align the clipping space of each conducting clip with the first notch or the second notch of the partition; and eventually the panel with the set of movable lids settled internally is placed on top of the partition so that its first plug hole and second plug hole are aligned with the first notch and the second notch of the partition respectively.

In the aforesaid socket with movable lids, the elastic member is suggested to be a spring in the shape of a long coil.

DETAILED DESCRIPTION OF THE INVENTION

Figure 1:
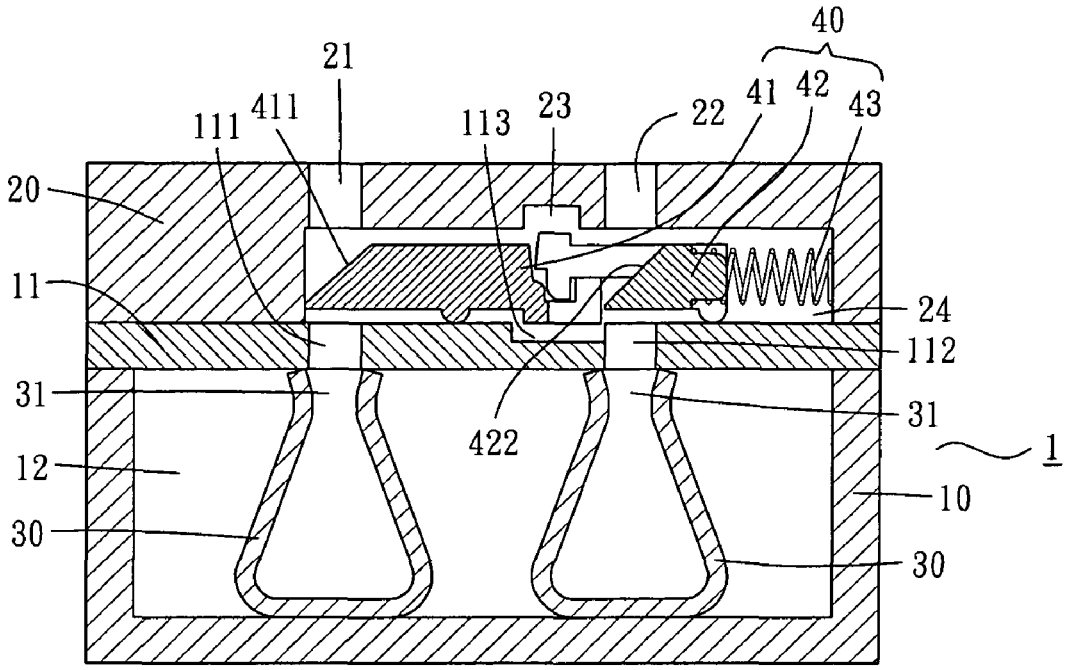
FIG. 1 is an assembled sectional view of the exemplary embodiment of this invention.

To achieve the foregoing objects of the present invention, the techniques adopted and the achievable functions are detailed described with reference to the following preferred exemplary embodiments and the accompanying drawings for a thorough comprehension.

Referring to FIGS. 1~4, the whole exemplary embodiment of this invention is a socket 1, comprising a shell 10, a panel 20, a conducting clip 30 and a set of movable lids 40, where the shell 10 has an empty top and is covered by a partition 11, to form a hollow 12 internally, and the partition 11 is provided with at least a first notch 111 and a second notch 112 that penetrate the partition 11, where the second notch 112 is provided with an adjacent clamping trough 113 at the side facing to the first notch 111.

The panel 20 is placed on top of the partition 11 of the shell 10 and forms a firm joint with the shell 10, where the panel 20 is provided with at least a first plug hole 21 and a second plug hole 22 that penetrate the panel 20, which correspond to the first notch 111 and the second notch 112 respectively, and the panel 20 is set up with an inward cavity 24 at its bottom and further with a deeper clamping groove 23 at the position corresponding to the clamping trough 113;

The number of conducting clips 30 is equal to the quantity of plug holes, where the conducting clips 30 are fixed in the hollow 12 of the shell 10 and each forms a clipping space 31, and the two clipping spaces 31 correspond to the first notch 111 and the second notch 112 of the partition 11 respectively, which further correspond to the first plug hole 21 and the second plug hole 22 of the panel 20 respectively.

Figure 3:
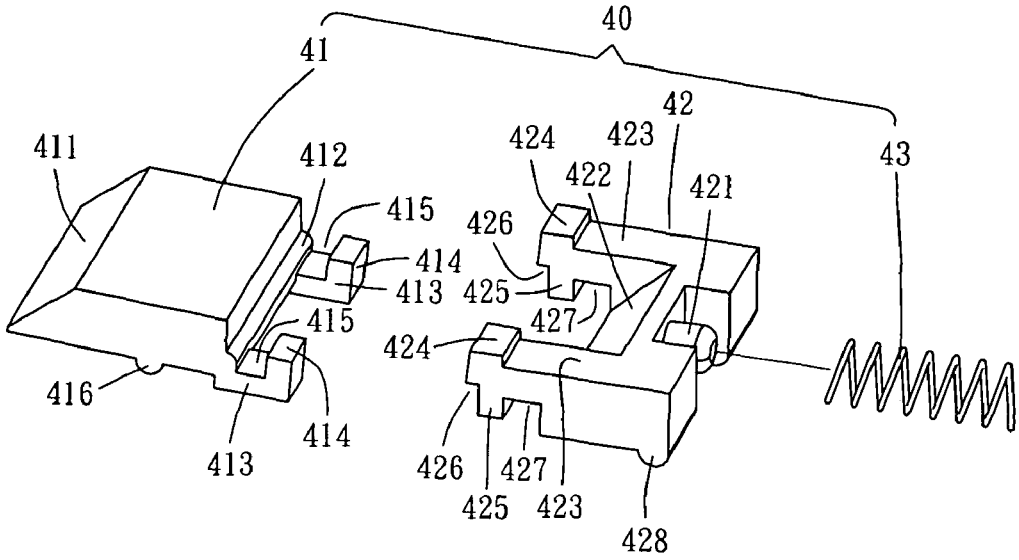
FIG. 3 is a three-dimensional exploded view of the set of the movable lids of the exemplary embodiment of this invention.

Referring to FIG. 3, the set of movable lids 40 is made up of a first lid 41, a second lid 42 and an elastic member 43, where the first lid 41 is in the shape of a chunk on which one lateral is formed into a tapered surface 411 and its opposite lateral is provided with a rib 412, and each side of it is protruded to form an extension 413 that further forms a bulge 414 at its end portion, which is targeted to set up an indent 415 in between the rib 412 and the bulge 414, and a protrusion 416 is shaped at the bottom of the first lid 41; the second lid 42 is in the shape of a chunk too, where its lateral opposite to the first lid 41 is set up with an indentation in which a pressing pole 421 is shaped, and the lateral next to the first lid 41 is set up with a tapered surface 422, where an extension 423 is projected at each of its two sides and a bulge 424 is further formed at the end portion, and a bump 425 is shaped at the bottom of each extension 423, where a recess 426 is formed at the outside of the bump 425 while an indent 427 at its inside, and a protrusion 428 is shaped at the bottom of the second lid 42; the elastic member 43 is suggested to be a spring in the shape of a long coil.

Figure 4:
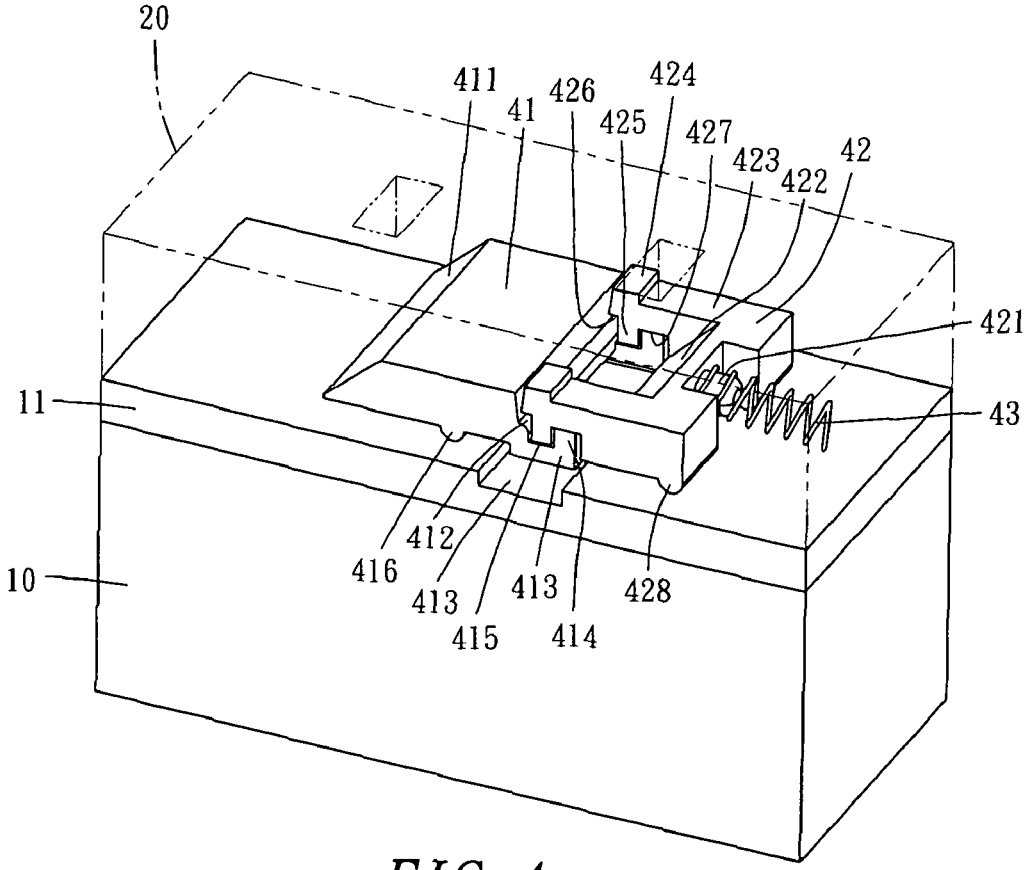
FIG. 4 is a three-dimensional assembled view of the exemplary embodiment of this invention.

The assembly of the set of the movable lids 40 is shown in FIG. 4, where the bumps 425 of the second lid 42 are lodged in the corresponding indents 415 of the first lid 41, to enable the recesses 426 to touch slightly the rib 412; meanwhile, the bulges 414 of the first lid 41 are exactly fit in the indents 427 of the second lid 42 respectively, followed by the wearing of one end (inner end) of the elastic member 43 on the pressing pole 421 for a firm fixing, to accomplish the assembly of the whole set of the movable lids 40.

Figure 2:
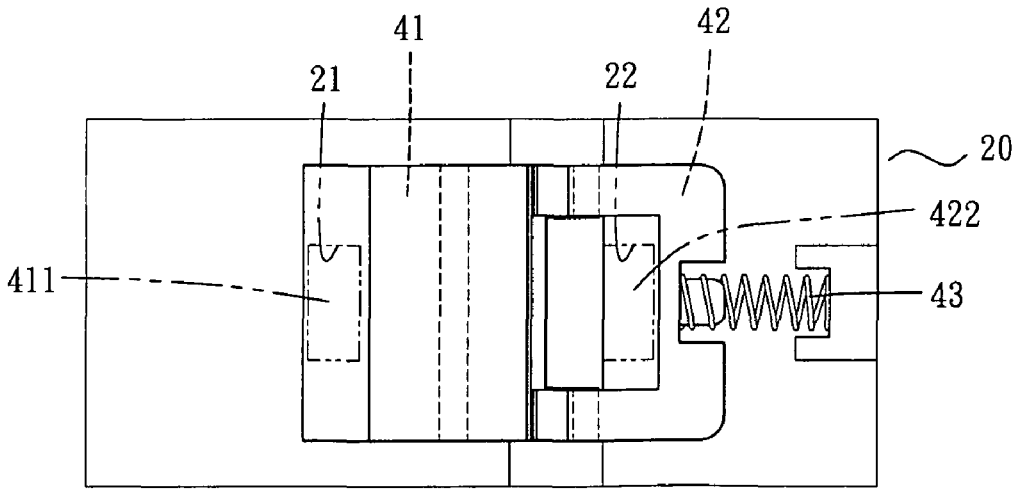
FIG. 2 is an assembled top view of the exemplary embodiment of this invention.

The assembly of the socket 1 of the exemplary embodiment of this invention is shown in the FIGS. 1, 2 and 4, where the whole set of the movable lids 40 are first placed in the cavity 24 of the panel 20 so that the front edge of the tapered surface 411 and the other end (outer end) of the elastic member 43 are propping against two opposite inner walls of the cavity 24 respectively for immobilization; on the other hand, the conducting clips 30 are placed in the hollow 12 of the shell 10 for immobilization, and the conducting clips 30 are connected to the bare ends (not shown in the figures) of the power cord for the electric conduction of the conducting clips 30, followed by placing the partition 11 on the shell 10, to align the clipping spaces 31 of the conducting clips 30 with the first notch 111 and the second notch 112 of the partition 11 respectively; and eventually the panel 20 with the set of movable lids 40 settled internally is placed on top of the partition 11 so that its first plug hole 21 and second plug hole 22 are aligned with the first notch 111 and the second notch 112 of the partition 11 respectively, which at the moment are pushed by the elastic member 43 (shown in FIG. 1), where the first lid 41 and the second lid 42 are moved forward so that the bottoms of the tapered surfaces 411, 422 are exactly barricading the first notch 111 and the second notch 112 of the partition 11.

Figure 5:
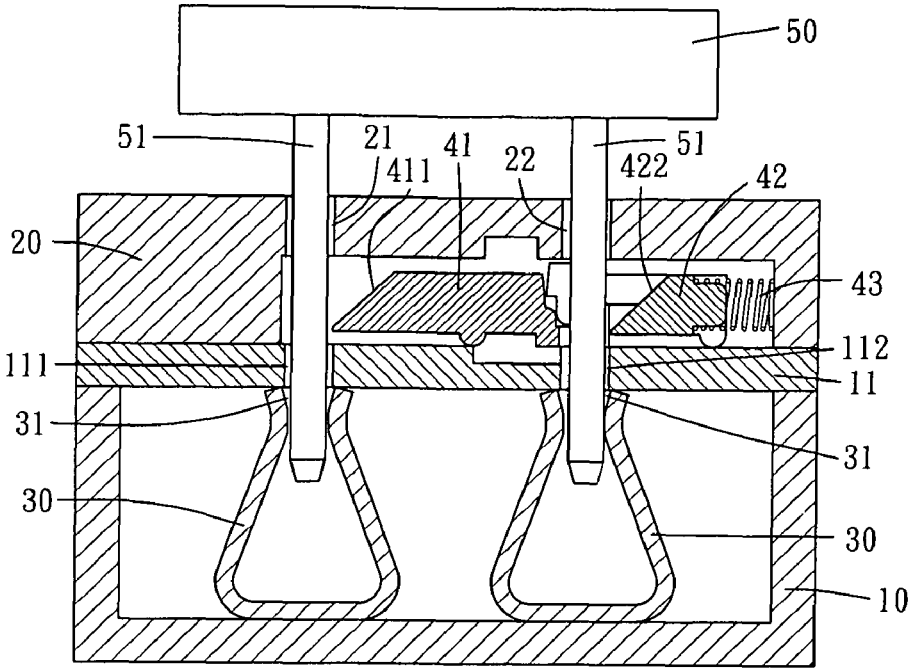
FIG. 5 is a schematic diagram of the correct use of the exemplary embodiment of this invention.

The normal use of the socket 1 of the exemplary embodiment of this invention is shown in FIG. 5, when the two pins 51 of the plug 50 of the power cord for an electric appliance are plugged into the first plug hole 21 and the second plug hole 22 of the panel 20 simultaneously, the bottoms of the two pins 51 will touch the tapered surfaces 411, 422 at the same time, the pressing will push the first lid 41 and the second lid 42 to move aside in the direction of squeezing the elastic member 43, which enables the first notch 111 and the second notch 112 of the partition 11 to be free of shielding, where the two pins 51 are then available to penetrate the first notch 111 and the second notch 112, and to insert in the clipping spaces 31 of the conducting clips 30 respectively for a clamping, where the electric appliance is conducted through the physical connection of the pins 51.

Figure 6:
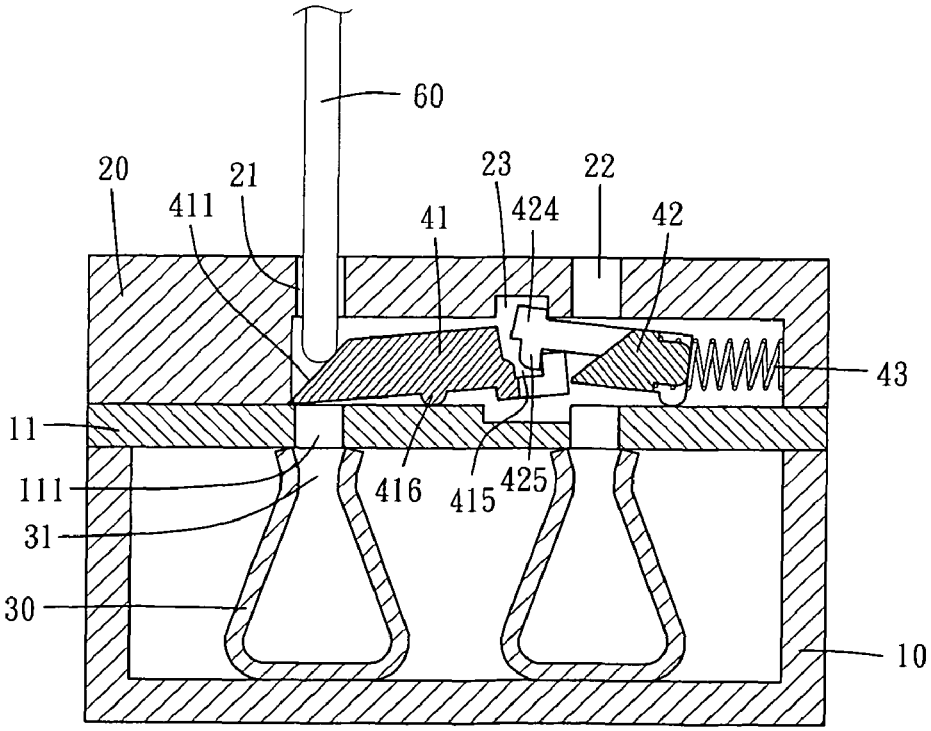
FIG. 6 is a schematic diagram of the first kind of wrong uses of the exemplary embodiment of this invention.

Once a user (exceedingly curious children are the most possible target) is inserting a stick-like object 60 into either the first plug hole 21 or the second plug hole 22 on the panel 20 incidentally or intentionally, a description of the outcome will be given as follows based on two different situations: insertion of the first plug hole 21 only and insertion of the second plug hole 22 only. Referring to FIG. 6, once the stick-like object 60 (including the insertion of one pin 51 only) is inserted into the first plug hole 21, its bottom will touch the tapered surface 411 of the first lid 41, and the pressing tends to push the first lid 41 to move toward the second lid 42; however, the second lid 42 couldn't retreat at the moment since it is subject to the inelasticity of the elastic member 43, and consequently the first lid 41 as a seesaw will move around its protrusion 416 which acts just as the fulcrum (the moving direction is shown in the figure); that is, the indent 415 of the first lid 41 will push the extremity of the second lid 42 with bump 425 and bulge 424 up, which enables the clamping groove 23 of the panel 20 to accommodate the bulge 424 for a stay; during the situation shown in FIG. 6, since the bottom of the tapered surface 411 of the first lid 41 completely barricades the first notch 111 of the partition 11 to keep the stick-like object 60 from entering the first notch 111 of the partition 11, not to mention the possibility of touching the conducting clip 30, which substantially keeps the user from the hazard of an electrical shock.

Figure 7:
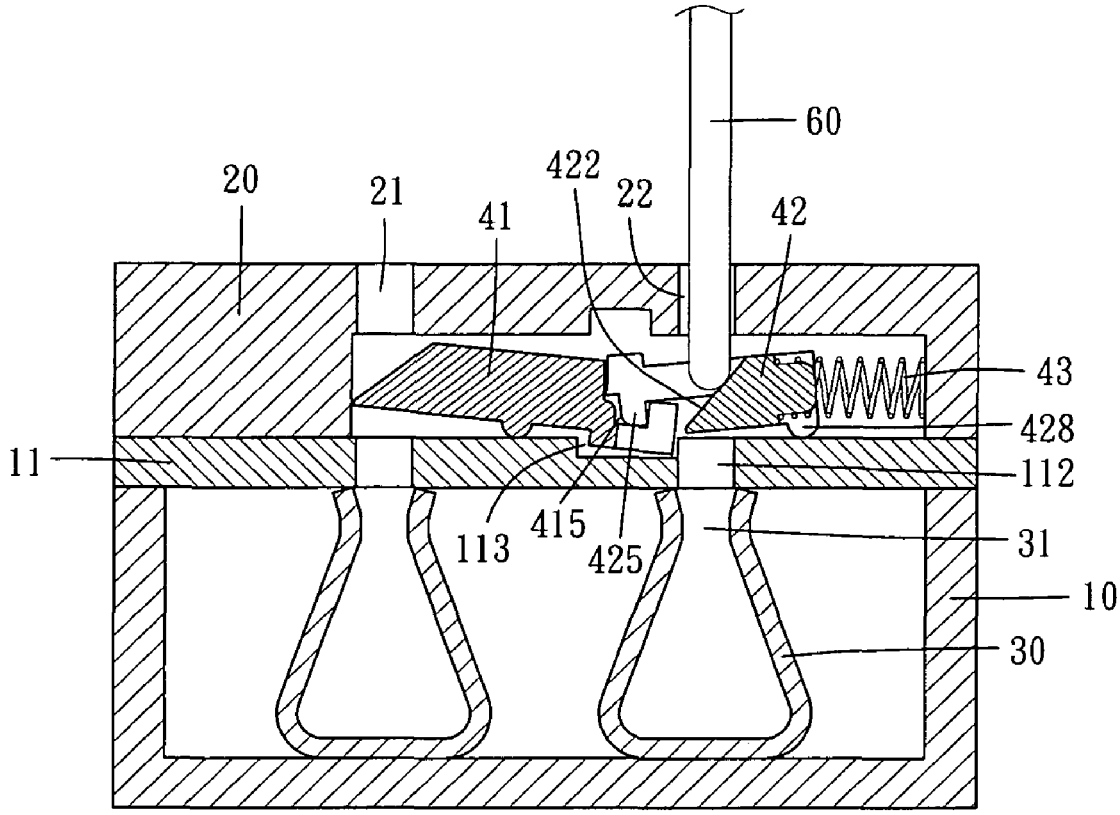
FIG. 7 is a schematic diagram of the second kind of wrong uses of the exemplary embodiment of this invention.

Referring to FIG. 7, as the stick-like object 60 (including the insertion of one pin 51 only) is inserted into the second plug hole 22 only, its bottom will touch the tapered surface 422 of the second lid 42, and the plugging force tends to push the second lid 42 to move toward the elastic member 43;

however, the first lid 41 doesn't move since it isn't subject to any external forces, and the second lid 42 as a seesaw moves around its protrusion 428 which acts just as the fulcrum (the moving direction is shown in the figure); therefore, the bump 425 of the second lid 42 will push the indent 415 of the first lid 41 down, which enables the clamping trough 113 of the partition 11 to accommodate the extension 413 for a stay; during the situation shown in FIG. 7, since the bottom of the tapered surface 422 of the second lid 42 completely barricades the second notch 112 of the partition 11 to keep the stick-like object 60 from entering the second notch 112 of the partition 11, not to mention the possibility of touching the conducting clip 30, which substantially keeps the user from the hazard of an electrical shock.

Accordingly, the purpose of this invention is to barricade the first notch 111 and the second notch 112 by the tapered surfaces 411, 422 of the first lid 41 and the second lid 42 respectively, subject to the accommodation of the set of movable lids 40 by the cavity 24 of the panel 20, which is used for the occasions that a user is inserting a stick-like object 60 into a single plug hole, either the first plug hole 21 or the second plug hole 22, of the panel 20 incidentally or intentionally, where the first lid 41 and the second lid 42 are available to hold up each other, to barricade the corresponding notch to avoid the insertion of the stick-like object 60 to touch the corresponding conducting clip 30, to keep the user from the hazard of an electrical shock.

In conclusion, the structural combination of this invention has not opened to the public, and it indeed accomplishes expected objective and function, which has fully complied with the requirements of patentability; however, the aforesaid exemplified embodiments of the present invention are used only for the illustration of combination and function, not for the constraint of the scope; any equivalent embodiments or modifications without departing from the spirit and scope of the present invention are therefore intended to be embraced.

What is claimed is:

1. A socket featuring movable lids for shielding plug holes, comprising a shell, a panel, a conducting clip and a set of movable lids, wherein the shell having an empty top and being covered by a partition, to form an internal hollow, wherein the partition is provided with at least a first notch and a second notch that penetrate the partition, and a clamping trough being formed adjacent to the second notch and at a side facing to the first notch; the panel being placed on top of the partition of the shell, and forming a firm joint with the shell, wherein the panel is provided with at least a first plug hole and a second plug hole that penetrate the panel, which correspond to the first notch and the second notch respectively, and the panel being formed with an inward cavity at a bottom and further formed with a clamping groove above the cavity and corresponding to the clamping trough; a plurality of conducting clips being equal to the quantity of plug holes, wherein the conducting clips are fixed in the hollow of the shell and each forming a clipping space, and the clipping spaces corresponding to the first notch and the second notch of the partition respectively; the set of movable lids being made up of a first lid, a second lid and an elastic member, wherein the first lid is in a shape of a chunk on which one lateral side is formed with a tapered surface and an opposite lateral side being provided with elongated rib, and each side of the rib being protruded to form an extension, wherein a bulge is formed at an end portion, which is formed with an indent in between the rib and the bulge, and a protrusion being shaped at the bottom of the first lid; the second lid being in a shape of another chunk, wherein the lateral side opposite to the first lid is formed with an indentation in which a pressing pole is extended outwardly from a back side of the second lid, and the one lateral side connecting to the first lid being formed with a tapered surface, wherein an extension is projected at each of two sides, and a bulge being further formed at the end portion of each extension while a bump is formed at the bottom of each extension, wherein a recess is formed at an outside of the bump while an indent is formed at an inside opposite to a side of the bump, and a protrusion being formed at the bottom of the second lid; during the assembly, the bump of the second lid being fitted in the corresponding indent of the first lid, to enable the recess to touch the rib, meanwhile, the bulge of the first lid being exactly fit in the corresponding indent of the second lid, followed by mounting of one end of the elastic member on the pressing pole and against a wall of the inward cavity for a firm fixing;

the set of the movable lids being placed in the cavity of the panel that a front rim of the tapered surface of the first lid and the other end of the elastic member are propping against two opposite inner walls respectively for a steady fixing; the conducting clips being placed in the hollow of the shell for immobilization, followed by placing the partition on the shell, to align the clipping spaces of the conducting clips with the first notch and the second notch of the partition respectively; and the panel with the set of movable lids being placed in the panel and on top of the partition so that the first plug hole and the second plug hole being aligned with the first notch and the second notch of the partition respectively.

2. A socket featuring movable lids for shielding plug holes as in claim 1 wherein the elastic member is suggested to be a spring in the shape of a long coil.

* * * * *